US006790129B2

(12) United States Patent
Moriya et al.

(10) Patent No.: US 6,790,129 B2
(45) Date of Patent: Sep. 14, 2004

(54) METHOD FOR POLISHING ANGULAR SUBSTRATES

(75) Inventors: Jiro Moriya, Niigata-ken (JP); Masataka Watanabe, Niigata-ken (JP); Satoshi Okazaki, Niigata-ken (JP); Hidekazu Ozawa, Tokyo (JP); You Ishii, Tokyo (JP); Shunichiro Kojima, Tokyo (JP)

(73) Assignee: Shin-Etsu Chemical Co., Ltd, Tokyo (JP)

( * ) Notice: Subject to any disclaimer, the term of this patent is extended or adjusted under 35 U.S.C. 154(b) by 0 days.

(21) Appl. No.: 10/214,114

(22) Filed: Aug. 8, 2002

(65) Prior Publication Data

US 2003/0036340 A1 Feb. 20, 2003

(30) Foreign Application Priority Data

Aug. 8, 2001 (JP) ..... 2001-240027

(51) Int. Cl.[7] ..... B24B 7/00
(52) U.S. Cl. ..... 451/41; 451/287; 451/398
(58) Field of Search ..... 451/41, 285, 287, 451/398, 63

(56) References Cited

U.S. PATENT DOCUMENTS 5,443,416 A 8/1995 Volodarsky et al.
5,584,751 A 12/1996 Kobayashi et al.
6,443,824 B2 * 9/2002 Shendon et al. ..... 451/288
6,454,637 B1 * 9/2002 Gotkis ..... 451/287
6,503,134 B2 * 1/2003 Shendon ..... 451/398
6,558,232 B1 * 5/2003 Kajiwara et al. ..... 451/41
6,579,151 B2 * 6/2003 Tseng et al. ..... 451/11
6,612,903 B2 * 9/2003 Korovin et al. ..... 451/9

FOREIGN PATENT DOCUMENTS

EP 1 053 979 A1 11/2000
JP 2000 218481 A 8/2000

* cited by examiner

*Primary Examiner*—Eileen P. Morgan
(74) *Attorney, Agent, or Firm*—Birch, Stewart, Kolasch & Birch, LLP

(57) ABSTRACT

An angular substrate polishing method includes the steps of holding an angular substrate having a surface to be polished within a guide ring of a substrate holding head; pressing the substrate surface to be polished, and also one surface of the guide ring, against a polishing pad; and independently rotating the polishing pad and the substrate-holding head together with the substrate it holds while pressing the polishing pad-contacting surface of the guide ring against the polishing pad, to thereby polish the substrate surface. During the polishing step, a pressing force is applied to the guide ring which is separate from the pressing force applied to the substrate, enhancing the flatness of the polished substrate.

13 Claims, 8 Drawing Sheets

METHOD FOR POLISHING ANGULAR SUBSTRATES

BACKGROUND OF THE INVENTION

1. Field of the Invention

This invention relates to a polishing method for planarizing angular substrates, and particularly to a method for polishing substrates of quadrangular shape such as photomask substrates, liquid crystal substrates and disk substrates. The invention relates additionally to photomask blanks and photomasks obtained using substrates planarized by the inventive polishing process.

2. Prior Art

As the level of DRAM integration has continued to rise, so has the demand for ever smaller microcircuit geometries. This has led in turn to the use of exposure light of increasingly shorter wavelength. Shorter wavelength light increases resolution, but reduces focal depth. Hence, improving the focal depth has become an important concern. Because one major factor affecting focal depth is the flatness of the photomask substrate used in the lithographic process, a higher degree of flatness is desired in the photomask substrates from which photomasks are made. For instance, a flatness of at least 0.5 $\mu$m, and especially 0.3 $\mu$m or better, is desired in photomasks measuring 152×152 mm.

Photomask substrates are usually made of synthetic quartz glass. The production of synthetic quartz glass substrate is briefly described. First, a glass ingot is formed by flame hydrolysis using gases generated from a starting material such as silicon tetrachloride and an oxyhydrogen flame. The ingot is melted under heating and molded into an angular shape. The angular ingot is cut into slices, which are then polished several times to increasing levels of precision, ultimately giving photomask substrates.

Such polishing is generally performed by polishing multiple slices at once on a double side polishing machine. Double-sided polishing is widely used in large part because, in addition to being beneficial for mass production, it also happens to be effective against scratching. Exposure light is passed through the photomask, so both sides of the photomask substrate from which the photomask is made must be free of scratches and other defects.

Double-sided polishing is described while referring to attached FIG. 1. Two polishing turntables 3 and 3', respectively composed of a lower platen 1*a* and an upper platen 1*b* to each of which is bonded a polishing pad 2, press from both sides against substrates to be polished 11 which have been inserted by a carrier (not shown). Polishing is carried out by independently rotating the turntables 3 and 3'. This arrangement allows both sides of the substrates 11 to be polished at the same time, which is effective for preventing scratches. FIG. 2 is a schematic view showing only one turntable 3 and one substrate to be polished 11. The substrate 11 rotates at the center, and so its surface is polished to a concentric shape.

When the substrate 11 is pressed against the polishing pad 2 during polishing, as shown in FIG. 3, the substrate 11 sinks into the pad 2 under the pressing force. At the start of such sinking, the polishing pad 2 exerts a large elastic force upon the substrate 11, increasing friction by the polishing pad 2 at places 11*a* (shaded areas) which correspond to the outside of the inscribed circle on the substrate 11 shown in FIG. 2. Moreover, because the substrate 11 being polished is an angular substrate, rotation of the substrate 11 subjects the shaded areas 11*a* to the successive application and release of pressing forces, vastly increasing the opportunities for the substrate 11 to incur the elastic forces of the polishing pad 2 compared to a circular substrate. The result is excessive abrasion of the substrate, rapid degradation at corresponding places on the polishing pad 2, and the emergence of unevenness in the elasticity and other characteristics of the polishing pad 2. Such unevenness in the properties of the polishing pad 2 prevents the substrate 11 from being polished at a uniform rate, as a result of which the surface of the substrate 11 is polished non-concentrically. In FIG. 3, the lengths of the arrows indicate the relative magnitude of the forces of restitution acting under the elasticity of the polishing pad 2.

Also, when a plurality of substrates are polished at the same time, the existence of variations in the thickness of the substrates prevents a uniform load from being applied to the substrates. Hence, the rate at which any one substrate is polished is not uniform, which tends to result in non-concentric polishing of the substrate surface.

In angular substrates, the polishing speed in peripheral areas thus tends to be too rapid, making it difficult to stably manufacture flat substrates. This has significantly lowered production yields.

Moreover, once the surface of a substrate has been non-concentrically polished, subsequent repair is difficult and it is essentially impossible to obtain a substrate of high planarity. This too has greatly lowered yields.

A need has thus been felt for a way to polish angular substrates which enables the stable production of angular substrates of high planarity by preventing the excessive removal of material in peripheral areas and controlling the polishing rate in the plane of the substrate.

Also, to obtain substrates which have been effectively planarized from the non-concentrically polished state that often arises in the prior art such as with the use of a double side polishing machine, there has been a desire for a way to produce planarized substrates, regardless of the substrate shape prior to polishing, by selectively polishing selected areas of the substrate.

Another important consideration is the importance at all times of keeping scratches and other defects from arising in the substrate during polishing.

SUMMARY OF THE INVENTION

It is therefore one object of the invention to provide a polishing process which is capable of finishing the surface of an angular substrate to a high degree of flatness and does not cause scratches and other defects to form, and particularly a polishing process which minimizes excessive material removal at the corners of the substrate.

It has been found that the problems described above can be overcome by polishing the substrate on a polishing machine while pressing the substrate and also similarly pressing a guide ring against the polishing pad.

Accordingly, in a first aspect, the invention provides a method for polishing an angular substrate having a surface to be polished, which method involves the steps of holding the angular substrate with a substrate holding head having a guide ring such that the substrate fits in the guide ring; pressing the substrate surface to be polished, and also one surface of the guide ring, against a polishing pad; and independently rotating the polishing pad and the substrate holding head together with the substrate it holds, while pressing the polishing pad-contacting surface of the guide ring against the polishing pad, to polish the substrate surface.

The substrate holding head typically has a holding side for holding a back surface of the substrate, and include an elastomer disposed on the holding side such as to contact primarily only peripheral areas of the back surface of the substrate.

The guide ring is preferably of a size which includes therein a circle whose diameter is equal to the diagonal of the substrate.

The substrate polishing method may employ one mechanism to apply a pressing force to the substrate and a different and independent mechanism to apply a pressing force to the guide ring.

The guide ring may be in one piece or divided into segments. If divided into segments, the divided guide ring is generally configured to allow a pressing force to be applied independently to each segment.

The ratio A/B between the pressing force A applied to the guide ring and the pressing force B applied to the substrate preferably satisfies the condition: $0<A/B\leqq 5$.

A surface portion of the guide ring in contact with the polishing pad is preferably made of a material that is a major constituent of the substrate. Both the substrate to be polished and the guide ring surface portion may be made of synthetic quartz glass.

The substrate in the method of the invention may be a photomask substrate.

In another aspect, the invention provides a photomask substrate obtained by the above-described substrate polishing method of the invention.

In a further aspect, the invention provides a photomask blank produced from the foregoing photomask substrate.

In a still further aspect, the invention provides a photomask produced from the foregoing photomask blank.

BRIEF DESCRIPTION OF THE DRAWINGS

The objects, features and advantages of the invention will become more apparent from the following description, taken in conjunction with the accompanying drawings.

DESCRIPTION OF THE PREFERRED EMBODIMENTS

As noted above, the angular substrate polishing method according to the invention includes the steps of holding the angular substrate with a substrate holding head having a guide ring such that the substrate fits in the guide ring; pressing the substrate surface to be polished, and also one surface of the guide ring, against a polishing pad; and independently rotating the polishing pad and the substrate holding head together with the substrate it holds, while pressing the polishing pad-contacting surface of the guide ring against the polishing pad, to polish the substrate surface.

Illustrative examples of angular substrates on which the polishing method of the invention may be used include substrates of square, rectangular and other quadrangular shapes, as well as substrates of other polygonal shapes. Quadrangular substrates such as photomask substrates, liquid crystal substrates and disk substrates are especially preferred.

An angular substrate has a pair of major surfaces, one of which is referred to as a surface to be polished and the other as a back surface. Polishing is carried out by vacuum chucking the substrate within the guide ring of a substrate holding head, carrying the substrate to and placing it on top of a polishing pad attached onto the platen in a single side polishing machine like that shown in FIG. 4, and independently rotating the polishing pad and the head together with the substrate.

Figure 5:
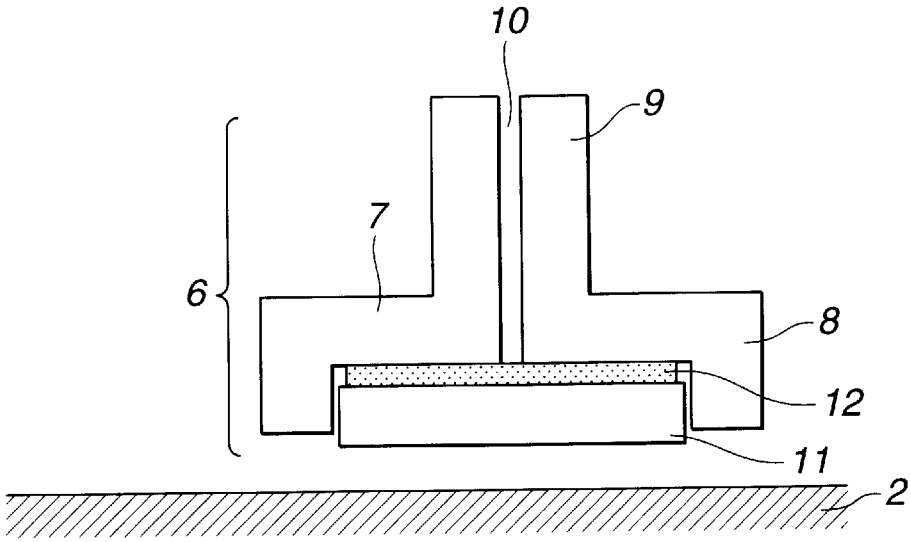
FIG. 5 is a sectional view of an example of a substrate holding head such as may be used in the method of the invention.

Referring to FIG. 5, a polishing turntable 3 includes a platen 1 and a polishing pad or cloth 2 attached thereto. An abrasive fluid 4 is fed to the center of the pad via an abrasive supply line 5. A substrate holding head 6 holds the substrate to be polished (not shown) and presses it against the polishing turntable 3. Independent rotation of the turntable 3 and the substrate holding head 6 in this state causes the substrate to be polished.

As shown in FIG. 5, the substrate holding head 6 has a planar top ring 7 of circular, quadrangular or other suitable shape provided on the periphery thereof with a guide ring 8. The top ring 7 has a cylinder 9 that rises up from the center of the outside face thereof. The top ring 7 and cylinder 9 have a fluid channel 10 which passes therethrough. A substrate to be polished (angular substrate) 11 located within the guide ring 8 is vacuum chucked to the inside face (holding face) of the top ring 7 by drawing a vacuum within the guide ring 8 through the fluid channel 10. In FIG. 5, the substrate 11 is shown attached to the inside face of the top ring 7 through an intervening packing film 12.

Thus, in the foregoing arrangement, vacuum attachment applied through the fluid channel 10 is used to hold the substrate 11 on the substrate holding head 6, which then carries the substrate 11 and places it on the polishing pad 2 for polishing. During polishing, a load can be applied to the substrate 11 by the substrate holding head 6 so as to press the substrate 11 against the polishing pad 2. Polishing can be effected at this time by feeding a pressurizing gas such as air or nitrogen through the fluid channel 10 to apply pressure to the substrate. The guide ring 8 is provided on the substrate holding head 6 to keep the position of the substrate 11 from shifting.

When a packing film 12 is used in the manner described above, the packing film 12 comes into contact with the back surface (the surface opposite the surface to be polished) of the substrate 11. During polishing, rubbing therebetween may cause scratches to form on the back surface of the substrate 11. Such scratches are undesirable because the exposure light passes through the photomask substrate. The repair of scratches formed in this way may require that the substrate 11 be turned over and polished on the other side. In such cases, it is recommended that an elastomer or synthetic resin 13 be used in the manner shown in FIG. 6 in place of a packing film 12. The elastomer or synthetic resin 13 is placed between the peripheral edge on the back surface of the substrate 11 which plays no part in exposure and the peripheral edge on the inside face (holding face) of the top ring 7 of the substrate holding head 6. During polishing of the substrate 11, the elastomer or synthetic resin 13 transfers the pressing force from the top ring 7 to the substrate 11. This arrangement makes it possible to keep scratches from forming on the back surface of the substrate 11 that is not polished. When an elastomer or synthetic resin 13 is placed in this way directly against the peripheral edge of the substrate 11 and a pressing force is applied therethrough by the top ring 7 to the substrate 11, the force is directly transferred to the peripheral areas of the substrate 11, making peripheral areas more subject to polishing. In such cases, a uniform polishing load throughout the substrate 11 can be achieved by the application of pressure such as with air or nitrogen through the fluid channel 10. Suitable examples of the elastomer or synthetic resin 13 include silicone rubbers, nitrile rubbers, styrene-butadiene rubbers, fluoroelastomers, polyacetal resins and fluorocarbon resins.

Figure 1:
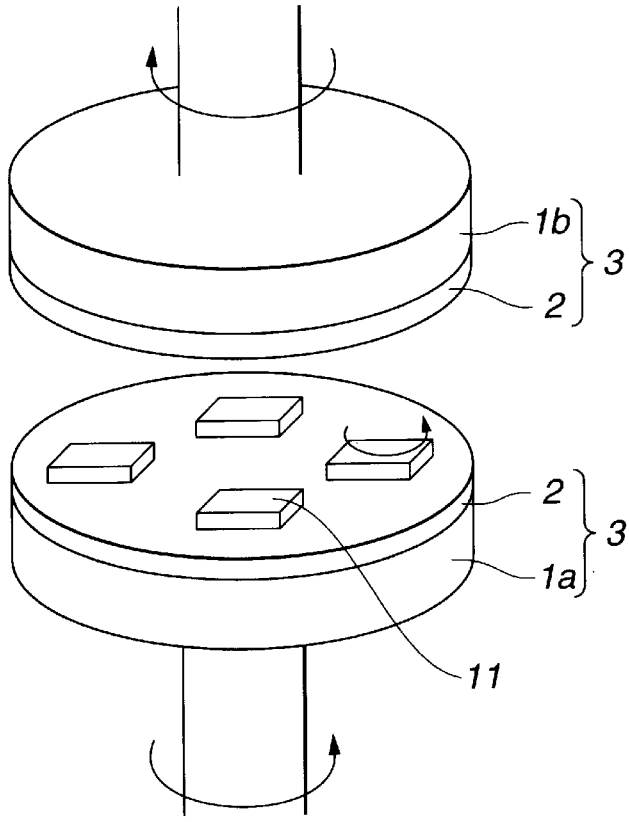
FIG. 1 is a perspective view of a double side polishing machine.
Figure 2:
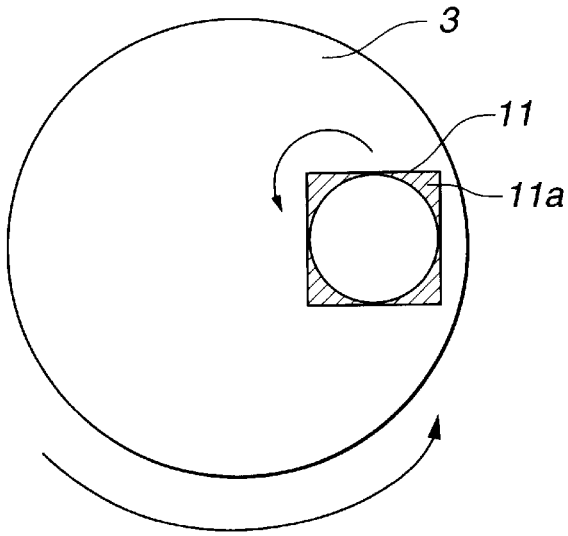
FIG. 2 illustrates a problem in the prior art for polishing angular substrates.
Figure 3:
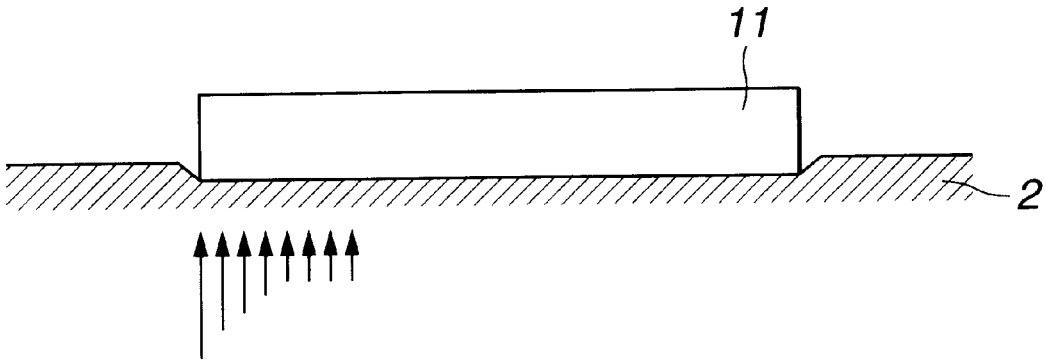
FIG. 3 is a sectional view showing the state of the polishing pad during polishing.

Even in single side polishing, as shown in FIG. 2, areas of the substrate 11 out of the inscribed circle are readily subject to the rapid removal of material. Referring to FIG. 3, which is a schematic view showing only the polishing pad 2 and the substrate to be polished 11, this is due in part to differences across the substrate 11 in its relative velocity with the polishing turntable 3. The main reason, however, is that the shaded areas 11*a* of the substrate 11 tend to undergo excessive polishing. Moreover, when the substrate 11 is pressed against the polishing pad 2 during polishing, it sinks into the polishing pad 2 under the pressing force in the manner shown in FIG. 3. At the start of such sinking, the polishing pad 2 exerts an elastic force upon the substrate 11, increasing friction by the polishing pad 2 and facilitating material removal in peripheral areas. In addition, because the substrate 11 is an angular substrate, the polishing pad 2 which polishes the shaded areas 11*a* successively generates the application and release of pressing forces from the substrate 11, which can cause the polishing rate to become excessive and lead to rapid degradation of the polishing pad 2 characteristics. This can in turn shorten the polishing pad 2 replacement cycle. The end result may be a decline in the overall productivity of polishing, due in part to such replacement work.

Thus, for example, even when trying to globally planarize a concave substrate by polishing, the polishing rate in peripheral areas is rapid, making it difficult to produce a stably planarized substrate.

In the practice of the invention, to prevent the excess removal of material in peripheral areas of the substrate, polishing of the substrate 11 is carried out while pressing the guide ring 8 against the polishing pad 2 in the same way as the substrate 11 is pressed.

Figure 6:
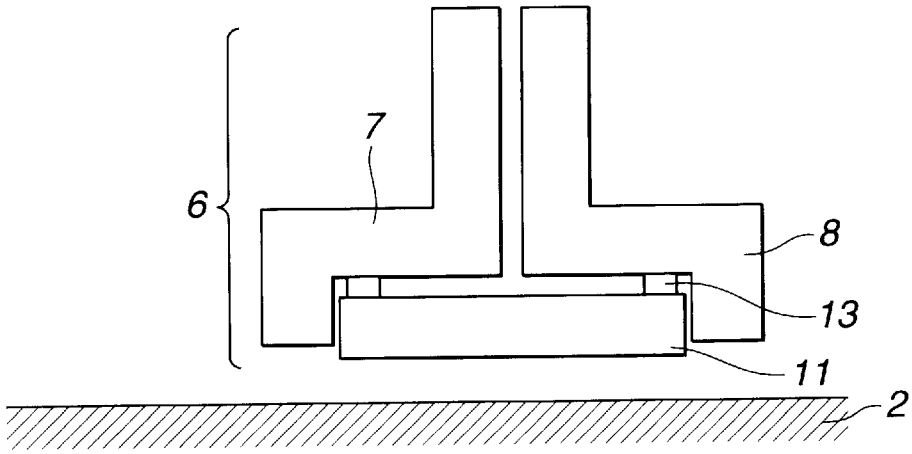
FIG. 6 is a sectional view of another example of a substrate holding head that may be used.

In this case, referring to FIG. 6, when the guide ring 8 is integral with the top ring 7 and a pressing force exerted by the top ring 7 presses the substrate 11 against the polishing pad 2, the surface to be polished on the substrate 11 and the leading face (pressing face) of the guide ring 8 may be made horizontally coplanar and the substrate 11 polished while pressing down on the guide ring 8. In this arrangement, it is desirable both to enable the guide ring 8 and the substrate 11 to be pressed down by separate mechanisms in the manner shown in FIG. 7, and to make the pressing force variable.

Accordingly, if the substrate to be polished 11 is concave, by making the pressing force on the guide ring 8 somewhat smaller than that on the substrate 11, the peripheral areas of the substrate 11 are polished more slowly than if no pressing force were applied to the guide ring 8, enabling the stable production of a substrate having a high flatness.

If the pressing force applied to the guide ring 8 is the same as the pressing force applied to the substrate 11, the elastic forces incurred by the substrate 11 from the polishing pad 2 are uniform. Hence, the in-plane pressing forces uniform and the in-plane polishing rate substantially constant.

When the substrate 11 is convex prior to polishing, a larger pressing force is applied to the guide ring 8 than to the substrate 11. This causes the polishing pad 2 to sink lower at the guide ring 8 than at the substrate 11. As a result, the peripheral areas of the substrate 11 do not incur strong elastic forces from the polishing pad 2, enabling the interior portions of the substrate 11 to be polished at a somewhat faster rate and thus making it possible to better planarize the substrate 11.

Figure 8:
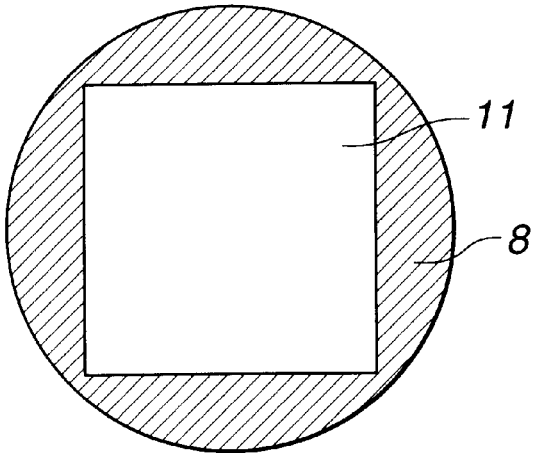
FIG. 8 is a schematic view showing an example of the guide ring used in the method of the invention.
Figure 9:
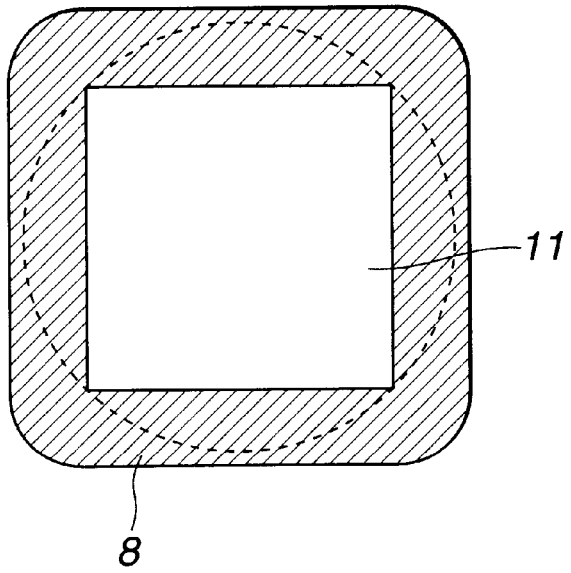
FIG. 9 is a schematic view of another example of the guide ring used in the invention.

In cases where the top ring 7 and guide ring 8 on the substrate-holding head 6 are of integral construction, the substrate 11 and the guide ring 8 are always set to a fixed height. However, this may make it impossible to apply the necessary pressing force in accordance with the precision during fabrication, wear of the guide ring 8 face in contact with the polishing pad 2 from constant use, and the shape of the substrate 11 prior to polishing. Hence, it is preferable to allow the guide ring 8 to be pressed by a mechanism independent of that used to press the substrate 11, and to have the pressing force applied to the guide ring 8 be variable The substrate 11 rotates about its center and is polished concentrically. To control the polishing rate within the plane of the substrate 11, it is preferable for the guide ring 8 to be of a size which includes a circle of a diameter equal to the diagonal of the substrate 11. The guide ring 8 may have any suitable shape. For example, it may be circular as shown in FIG. 8 or quadrangular with rounded corners as shown in FIG. 9.

The guide ring 8 may be made of any suitable material without particular limitation, such as polyvinyl chloride, polyphenylene sulfide (PPS) or polyetheretherketone (PEEK). It is preferable for the portion of the guide ring 8 which comes into contact with the polishing pad 2 to be made of a material that is a major constituent of the substrate 11. Use of exactly the same material is especially preferred. Thus, when the substrate 11 is made of synthetic quartz glass, it is desirable for the portion of the guide ring 8 which contacts the substrate 11 to be made of the same synthetic quartz glass. When a different material is used in the guide ring 8, polishing debris from the guide ring 8 or polishing pad 2 may scratch the substrate 11.

When the pressing force on the guide ring 8 is much larger than the pressing force on the substrate 11, the polishing pad 2 undergoes a deterioration in properties, especially a loss of elasticity, and the surface of the polishing pad 2 becomes worn and coarse, which can lead to scratching of the substrate 11 by the polishing pad 2. For this reason, it is desirable for the ratio A/B between the pressing force A applied to the guide ring 8 and the pressing force B applied to the substrate 11 to satisfy the condition $0<A/B\leqq 5$, and especially $0<A/B\leqq 2$.

In the practice of the invention, when a substrate 11 is polished in the manner described above, polishing of the substrate 11 is carried out while pressing down on both the substrate 11 and the guide ring 8. However, in the case of a substrate having a non-concentric surface, such as sometimes arises in the double-sided polishing of multiple substrates, it may be difficult to obtain a substrate of high planarity merely by pressing the guide ring 8 in the same way as above.

Figure 7:
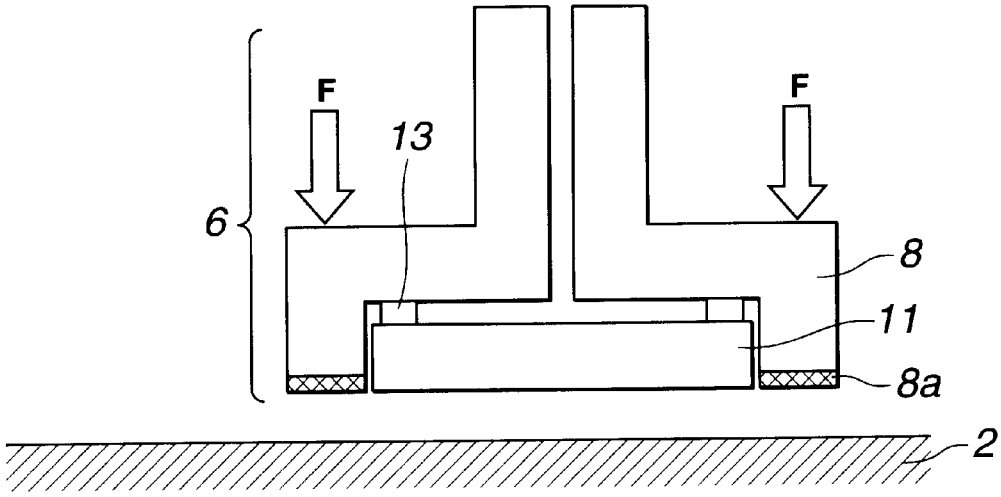
FIG. 7 is a sectional view of yet another example of a substrate holding head.

This problem can be overcome by using the substrate holding head 6 shown in FIG. 7 and relying on a divided mechanism to apply pressing forces to the guide ring 8. That is, we have found that a convex area on the surface of the substrate 11 can be selectively polished by either not applying a pressing force to the guide ring 8 or subjecting it to a smaller pressing force than that applied to the substrate 11. Although the size and other characteristics of the divided mechanism are not subject to any particular limitations, in one example of a four-part mechanism, shown in FIG. 10, four segments (1) to (4) are configured to independently apply pressing forces at corresponding places on the respective sides. In the eight-part mechanism shown in FIG. 11, four of the segments—(2), (4), (6) and (8)—are configured to apply pressing forces to respective corners of the substrate 11, and the remaining four segments—(1), (3), (5) and (7)—are configured to apply pressing forces to the centers of respective sides of the substrate 11.

For example, in the case of a substrate having a semicylindrical shape, the convex region can be selectively polished to obtain a substrate of high planarity, either by not applying pressing forces to the guide ring segments in the convex region or by making the guide ring pressing forces smaller than the substrate pressing forces.

By varying the pressing forces of the divided guide ring from one place to another according to the shape of the substrate, it is also possible to control the force applied to the guide ring at any given place so as to be the same, smaller or larger than the force applied to the substrate.

In the foregoing embodiments of the invention, the angular substrate is assumed to be square. However, effects like those described can be achieved even when the substrate is rectangular or polygonal, provided the guide ring is configured to surround the periphery of the substrate by appropriate modification of the shape and/or number of guide ring segments in any practical way.

Angular substrates, and especially photomask substrates, produced by the polishing method of the invention have a high global planarity, including peripheral areas of the substrate. Photomask blanks made from such substrates, and photomasks produced in turn from such photomask blanks by a conventional patterning process, are of high precision, enabling the accurate formation of desired patterns of small geometry.

EXAMPLES

Examples are given below by way of illustration and not by way of limitation.

Example 1

Figure 4:
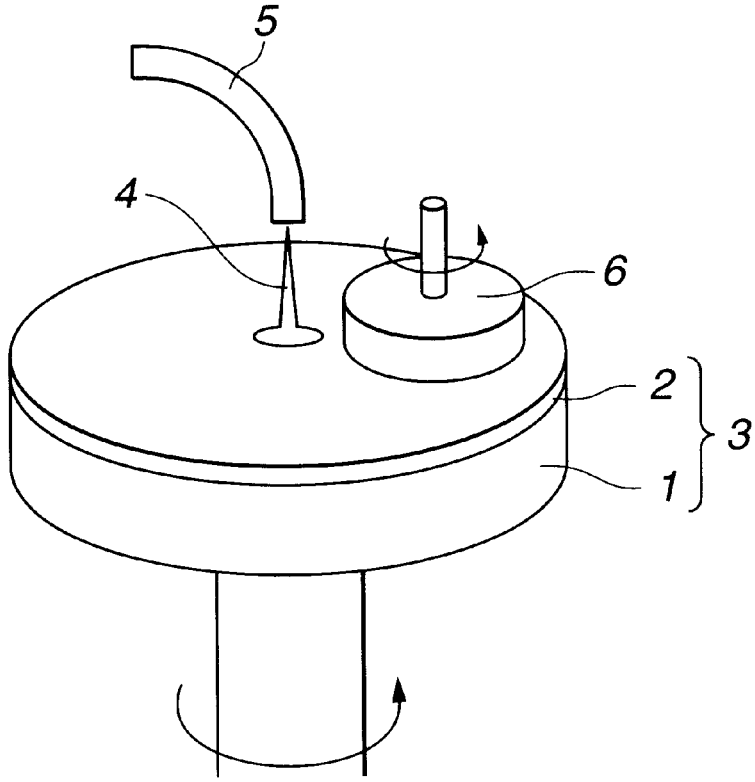
FIG. 4 is a perspective view of a single side polishing machine.

A photomask substrate with dimensions of 152×152 mm and a thickness of 6.35 mm was set in a polishing machine of the type shown in FIGS. 4 and 7. A suede-like polishing pad and a silica-base abrasive slurry were used. The guide ring had the shape shown in FIG. 9 and was made of polyvinyl chloride, although the portion of the guide ring which contacts the polishing pad was made of synthetic quartz glass, which was the same material as that making up the photomask substrate.

Prior to polishing, the substrate was concave and had an in-plane flatness of 0.5 μm over an area measuring 146×146 mm.

The pressing forces on the substrate and the guide ring were set at 30 kPa and 15 kPa, respectively. The rotational speeds of the substrate holding head and the polishing turntable were set at 30 rpm and 33 rpm, respectively. The polishing time was 10 to 100 seconds.

The flatness of the substrate was measured using an FT-900 flatness tester supplied by Nidek Co., Ltd. The results are shown in FIG. 12.

Comparative Example 1

Polishing was carried out in the same way as in Example 1. A pressing force was not applied at the guide ring. The polishing time was set at 10 to 60 seconds. Measurement of the substrate flatness was carried out in the same way as in Example 1. The results are shown in FIG. 13.

Figure 12:
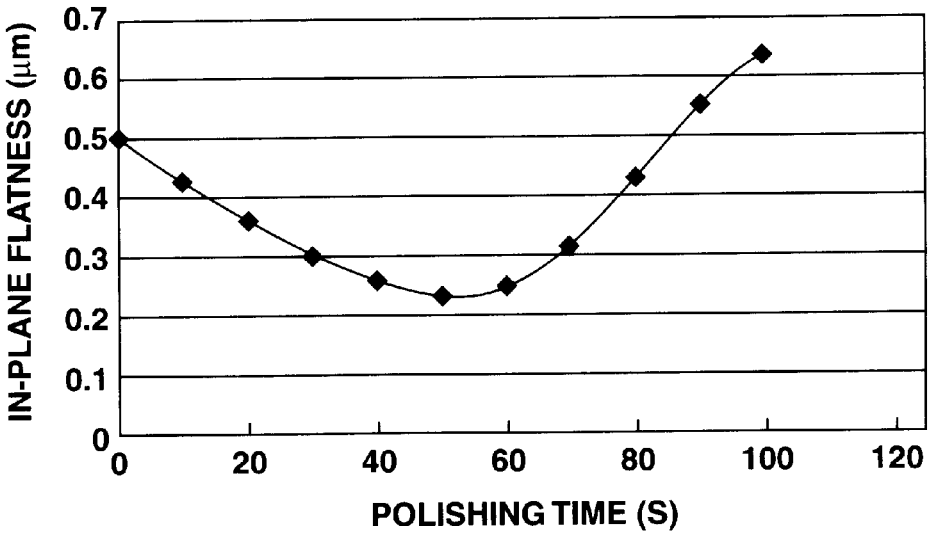
FIG. 12 is a graph of polishing time versus in-plane flatness in Example 1 according to the invention.
Figure 13:
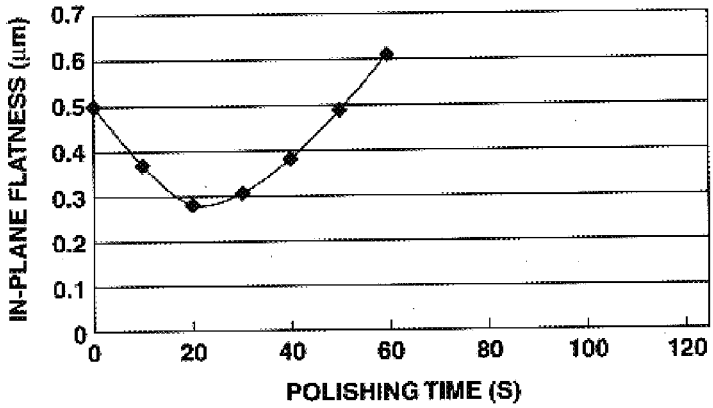
FIG. 13 is a graph of polishing time versus in-plane flatness in Comparative Example 1.

On comparing FIGS. 12 and 13, it is apparent that applying a pressing force with the guide ring provides better flatness and allows a flat substrate to be more easily achieved. For example, a flatness of 0.3 μm or better was achieved for a period of about 10 seconds (between polishing times of 18 to 30 seconds) when a force was not applied with the guide ring. By contrast, the same degree of flatness was achieved for a period of about 40 seconds (between polishing times of 30 to 70 seconds) when a force was applied with the guide ring, thus providing a greater amount of play in the polishing time.

Example 2

The substrate prior to polishing was convex, and had dimensions of 146×146 mm and a flatness of 0.4 μm. Polishing was carried out in the same way as in Example 1, except that the force applied to the substrate was 30 kPa, the force applied to the guide ring was 60 kPa, and the polishing time was set at 900 seconds.

Comparative Example 2

Polishing was carried out as in Example 2, except that a pressing force was not applied to the guide ring.

A comparison of the results obtained from Example 2 and Comparative Example 2 shows that the flatness improved to 0.35 μm in Example 2. By contrast, in Comparative Example 2, excessive material was removed in peripheral areas, giving the substrate a worse flatness after polishing than before.

Example 3

Figure 10:
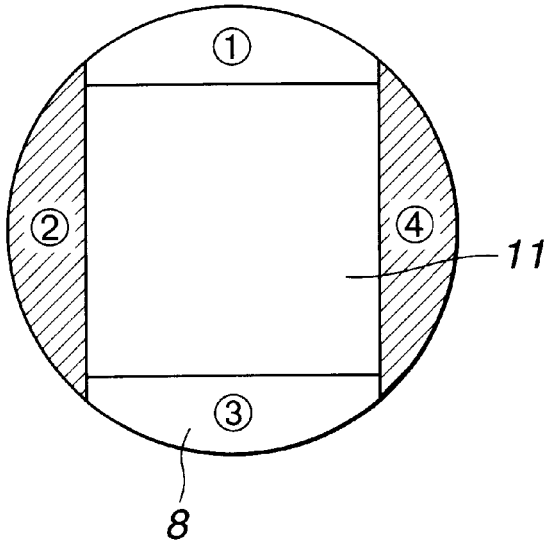
FIG. 10 is a schematic view showing an example of a divided guide ring according to the invention.
Figure 11:
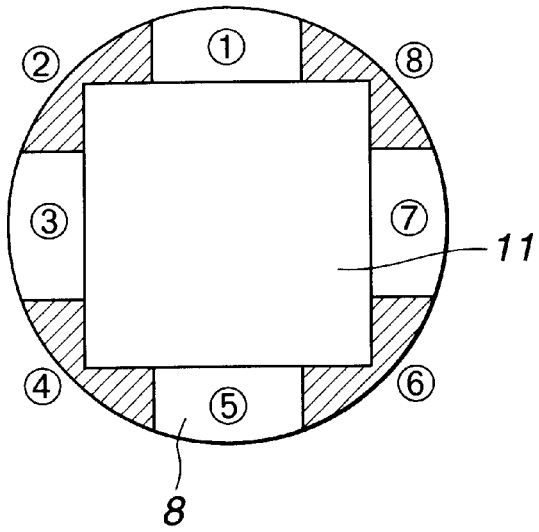
FIG. 11 is a schematic view of another example of a divided guide ring according to the invention.
Figure 14:
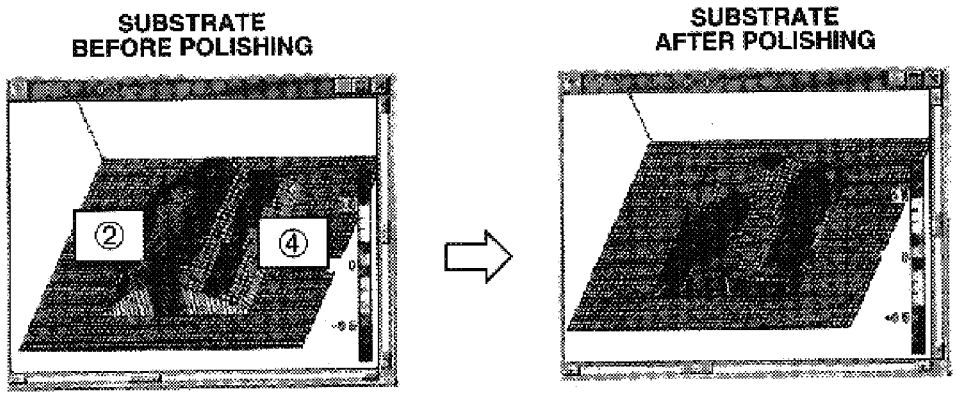
FIG. 14 shows the surface shape of the substrate before and after polishing in Example 3.

The substrate prior to polishing had a semicylindrical shape, and the divided guide ring shown in FIG. 10 was used. Polishing was carried out in the same way as in Example 1, except that a force of 30 kPa was applied to the substrate and to segments (2) and (4) of the guide ring, but no force was applied to segments (1) and (3) of the guide ring. FIG. 14 shows the substrate before and after polishing. The flatness improved from 0.52 μm before polishing to 0.28 μm after polishing.

A divided guide ring was provided in order to selectively polish a raised area. A pressing force was not applied to the guide ring in the raised area, whereupon that area was selectively polished, resulting in a flat substrate.

Example 4

Figure 15:
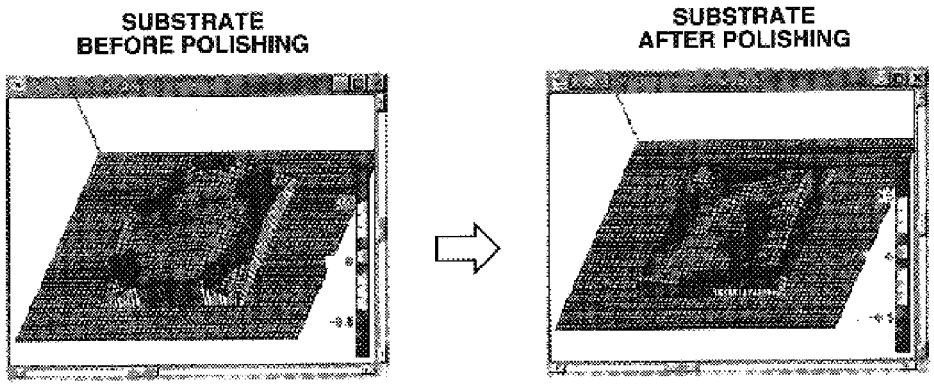
FIG. 15 shows the surface shape of the substrate before and after polishing in Example 4.

The unpolished substrate was a substrate in which the peripheral edge was high at the center. The divided guide ring shown in FIG. 11 was used. Polishing was carried out in the same way as in Example 1, except that a force of 30 kPa was applied to the substrate and to segments (2), (4), (6) and (8) of the guide ring, but no force was applied to segments (1), (3), (5) and (7). FIG. 15 shows the substrate before and after polishing. The flatness improved from 0.48 $\mu$m before polishing to 0.20 $\mu$m after polishing.

A divided guide ring was provided in order to selectively polish raised areas. A pressing force was not applied to the guide ring in the raised areas, whereupon those areas were selectively polished, resulting in a flat substrate.

Test Example

One hundred substrates were each polished for 5 minutes by the same polishing machine and method as in Example 1. After polishing was completed, the number of scratches on each substrate was counted by a defect inspection under a stereomicroscope. Bright spots were examined under a Nomarski microscope, and recessed features were counted as scratches. The results are given below in Table 1.

In a separate run, polishing was carried out as above, but using a guide ring in which the surface portion that contacts the polishing pad was made of polyvinyl chloride. Following the completion of polishing, the number of scratches on each substrate was counted. The results are given below in Table 1.

TABLE 1

| Guide ring material at surface which contacts polishing pad | Average number of scratches | |
|---|---|---|
| | Synthetic quartz glass | Polyvinyl chloride |
| 1st to 20th substrate | 0 | 1 |
| 21st to 40th substrate | 0 | 0 |
| 41st to 60th substrate | 0 | 7 |
| 61st to 80th substrate | 1 | 12 |
| 81st to 100th substrate | 0 | 11 |

When the surface portion of the guide ring which contacts the polishing pad was made of the same material as the substrates being polished (i.e., synthetic quartz glass), the substrates were generally free of scratches. By contrast, when the surface portion of the guide ring which contacts the polishing pad was made of polyvinyl chloride, which is a different material from that making up the substrates, the number of scratches increased. This was due both to polishing debris generated by the action of the polishing slurry on the guide ring, and also to wear and coarsening of the polishing pad.

As described above and demonstrated in the foregoing examples, when an angular substrate is polished by the method of the invention, the application to the guide ring of a pressing force which is separate from the pressing force applied to the substrate enhances the flatness of the polished substrate and enables a flat substrate to be stably achieved. Moreover, the guide ring is made of the same material as the substrate, which additionally enables scratching of the substrate to be prevented. Finally, by giving the guide ring a divided construction and pressing the desired areas of the guide ring against the polishing pad according to the shape of the substrate, angular substrates having a high degree of flatness can be achieved regardless of the surface shape of the substrate prior to polishing.

Japanese Patent Application No. 2001-240027 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A method for polishing a quadrangular substrate having a surface to be polished, comprising the steps of:

holding the substrate with a substrate holding head having a guide ring of a size which includes therein a circle whose diameter is equal to the diagonal of the substrate such that the substrate fits in the guide ring;

pressing the substrate surface to be polished, and also one surface of the guide ring, against a polishing pad; and independently rotating the polishing pad and the substrate holding head together with the substrate it holds, while pressing the polishing pad-contacting surface of the guide ring against the polishing pad, to polish the substrate surface.

2. The substrate polishing method of claim 1, wherein the substrate holding head has a holding side for holding a back surface of the substrate, and includes an elastomer disposed on the holding side which is primarily in contact with only peripheral areas of the back surface of the substrate.

3. The substrate polishing method of claim 1, which employs one mechanism to apply a pressing force to the substrate and a different and independent mechanism to apply a pressing force to the guide ring.

4. The substrate polishing method of claim 1, wherein the guide ring is in one piece.

5. The substrate polishing method of claim 1, wherein the guide ring is divided into segments.

6. The substrate polishing method of claim 5, wherein the divided guide ring is configured to allow a pressing force to be applied independently to each segment.

7. The substrate polishing method of claim 1, wherein a ratio A/B between the pressing force A applied to the guide ring and the pressing force B applied to the substrate satisfies the condition: $0<A/B\leqq 5$.

8. The substrate polishing method of claim 1, wherein a surface portion of the guide ring in contact with the polishing pad is made of a material that is a major constituent of the substrate.

9. The substrate polishing method of claim 8, wherein the substrate is made of synthetic quartz glass and the material making up the guide ring surface portion is synthetic quartz glass.

10. The substrate polishing method of claim 1, wherein the substrate is a photomask substrate.

11. A photomask substrate obtained by the polishing method of claim 10.

12. A photomask blank produced from the photomask substrate of claim 11.

13. A photomask produced from the photomask blank of claim 12.

* * * * *